United States Patent [19]

Romano

[11] Patent Number: 4,858,871

[45] Date of Patent: Aug. 22, 1989

[54] CLIP FOR FASTENING AN OBJECT TO A SUPPORT BY MEANS OF A HOOK AND DEVICE FOR FITTING SUCH A CLIP

[76] Inventor: Robert Romano, 47 avenue du Marechal Joffre, 94170 Le Perreux, France

[21] Appl. No.: 143,476

[22] Filed: Jan. 13, 1988

[30] Foreign Application Priority Data

Jan. 13, 1987 [FR] France ..... 87 00252

[51] Int. Cl.[4] ..... B42F 13/00

[52] U.S. Cl. ..... 248/339; 248/225.2; 248/301; 248/475.1; 248/489

[58] Field of Search ..... 248/339, 359 G, 359 B, 248/359 I, 475.1, 489, 225.2, 227, 301, 304, 216.1, 218.3, 217.3; 40/152.1

[56] References Cited

U.S. PATENT DOCUMENTS

| | | | |
|---|---|---|---|
| 1,350,784 | 8/1920 | Colburn | 248/359 B |
| 2,105,061 | 1/1938 | Tate et al. | 248/301 X |
| 4,712,761 | 12/1987 | Wassell | 248/475.1 |
| 4,736,917 | 4/1988 | Thuresson | 248/339 X |
| 4,756,498 | 7/1988 | Frye | 248/339 X |

*Primary Examiner*—Ramon O. Ramirez

*Attorney, Agent, or Firm*—Armstrong, Nikaido, Marmelstein, Kubovcik & Murray

[57] ABSTRACT

The clip of the present invention consists of a sheet which is made up of a first, second and third section. The first section contains a hole. The second sections forms an obtuse angle with the first section and has a central cutout. The third section is folded back along the second section such that the third section does not lie in the obtuse angle. The third section has two points for penetrating an object that is to be fastened by means of a hook.

7 Claims, 4 Drawing Sheets

CLIP FOR FASTENING AN OBJECT TO A SUPPORT BY MEANS OF A HOOK AND DEVICE FOR FITTING SUCH A CLIP

FIELD OF THE INVENTION

This invention relates to a clip for fastening an object to a support such as, for example, a frame to a wall, by means of a hook. The invention also relates to a device for fitting such a clip.

BACKGROUND OF THE INVENTION

Presently there are a number of devices for fastening objects to a support by means of a hook. One example are rings that are detachably fixed on the back of the object. The advent of synthetic materials forming the back of frames has led to the use of rings that are fixed on those materials by means of clips. The clip penetrates through the layer of material. Thus, it is necessary for the front of the material to be covered with cardboard or a similar material of a certain thickness in order to make the front completely smooth and flat before, for example, an engraving or picture is fixed thereon.

SUMMARY OF THE INVENTION

Therefore, one object of this invention is to propose a clip that obviates the need for placing a layer between the backing material and the document that is to be framed.

Another object of the invention is to propose a type of clip that can be driven into all types of materials which form the backing of a frame.

This invention also proposes a simple and reliable device for fitting such clips.

These and other objects, that will become apparent hereinafter, are achieved by a chip for fastening an object to a support by means of a hook. The clip comprises a metal plate which comprises a first, second, and third sections. The first section is a hooking device. The second section forms an obtuse angle with the first section. The third section is folded back along the second section such that the third section is not situated within the obtuse angle. The third section can penetrate the object that is to be fastened by a hook.

Preferably, the second section has a central cutout that enables the clip to be positioned on a fastening device, so that it can be fastened to the object by means of a hook.

The hooking device is a hole made in the first section. The hole will thus cooperate with a suspension device such as wall hooks and ring hooks which are driven into the support to which the object is to be fastened.

Preferably, the penetration device is formed by a beveled rectilinear or rounded edge, which determines the free end of the third section. The penetration device can also be formed by a point having a tip which is located in the plane of symmetry of the clip to form the third section. Additionally, the penetration device can be formed by the two points that extend the second section on both sides of the central cutout to form the third section.

The obtuse angle formed by the first and second sections is between 145 end 165 degrees and preferably between 150 and 155 degrees.

As stated above, the invention also relates to a device for fitting these clips. The device comprises a substantially flat face, including a placement device for placing an object into which a clip is to be driven. A bracket rests on the base. A rocking assembly has a substantially rectangular shape. A first end of the rocking assembly is hinged to the bracket and rotates about an axis between a high position, called the position of rest, and a low position called the contact position. A driving-in device comprises a head on a first side. The head is hinged to the second end of the rocking assembly which moves around an axis. The head can assume two positions. The first position is a rearward position, called the loading position. The second position is a forward position, called the drive-in position. The second side of the driving-in device has a lever which is connected to the head. The lever enables the rocking assembly to pivot about its axis in order to pass from the position of rest to the contact position. The lever also allows the head to pivot about its axis in order to pass from the loading position to the drive-in position. The head comprises an upper face. The upper face is defined as turned toward a user when the head is in the loading position and the rocking assembly is in the position of rest. A thrust means is located on the upper face of the head and cooperates with the central contact. The head also has a device for holding the clip on the head. A first returning device of the rocking assembly is provided in order to restore the rocking assembly to its position of rest. A second returning device of the head is more rigid than the first returning device in order to restore the head to its loading position.

The device for holding the clip on the head is a magnet. Preferably, the bracket consists of two side bars that are parallel to each other and between which is disposed the rocking assembly. The rocking assembly is made up of two parallel and substantially rectangular elements, between which the driving-in device is situated.

The fitting device for the clips has high and low stop pins which are located between the two side bars of the bracket. The pins determine the high and low positions between which the rocking assembly can rotate. A stop is placed between the two elements of the rocking assembly to determine the rearward position of the head. A stud is located on the head and cooperates with a pin located between the two elements, in order to determine the forward position of the head. The stop and the stud are adjustable.

The first returning device consists of a first helical spring. A first end of the spring is fixed on a first bar placed between the two side bars of the bracket. The second end of the spring is extended by wire which passes above the axis of rotation of the rocking assembly. The second end of the spring is attached to a second bar situated between the elements of the rocking assembly. The second returning device consists of a second helical spring, one end of which is fixed on the second bar and the other end is fixed on the lower face of the head near a junction with the lever.

BRIEF DESCRIPTION OF THE DRAWINGS

The ensuing description, which is by no means limiting, should be read with reference to the accompanying drawings, in which.

DESCRIPTION OF THE PREFERRED EMBODIMENTS

Figure 1:
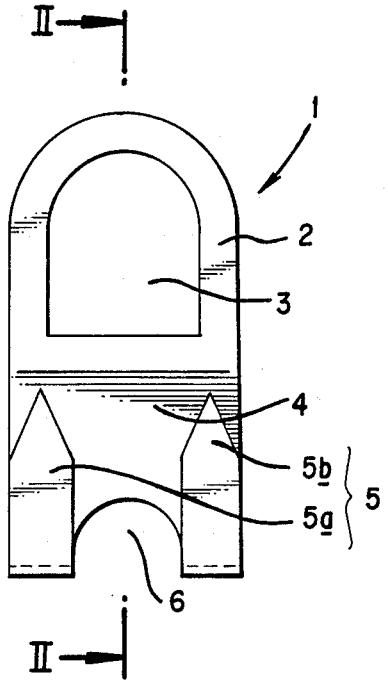
FIG. 1 is a front view of a clip of the preferred embodiment of the invention.
Figure 2:
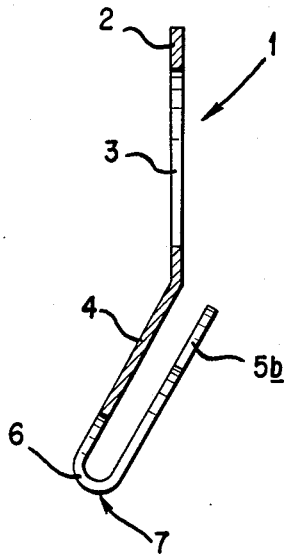
FIG. 2 is a cross-sectional view taken along the line II—II of the clip in FIG. 1.

FIGS. 1 and 2 show one preferred embodiment of the invention. A clip for fastening an object to a support by means of a hook consists of a metal plate generally denoted by reference numeral 1. The metal plate 1 has three sections. A first section 2 has a hole 3 that enables the clip to be hung on a suspension means such as an eye or a hook. A second section 4 forms an obtuse angle of about 152 degrees to the first section 2. A third section is folded back along the second section 4 such that the third section is not situated within the obtuse angle defined by the first section 2 and the second section 4.

The second section 4 has a central cutout which, in this embodiment, leads into the fold 7 connecting the second section 4 to the third section 5.

The third section 5 consists, according to one preferred embodiment of the invention, of two points 5*a* and 5*b*, which extend the second section 4 on both sides of the central cutout 6. The driving of these two points into an object will enable the clip to be fixed to the object and will enable the clip to be fastened to a support by means of a hook.

Figure 3:
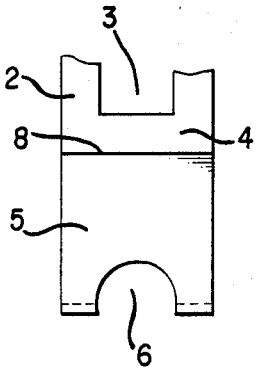
FIGS. 3, 4, and 5 are front views of three other types of clips of the invention.
Figure 4:
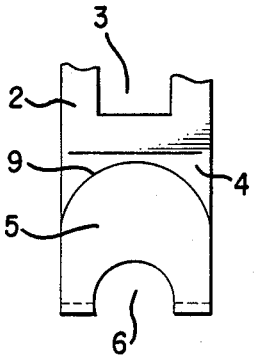
Figure 5:
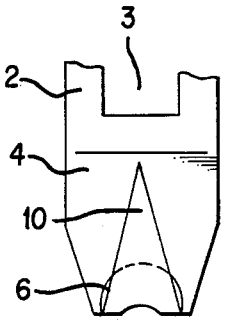

The third section 5 may also have as a means of penetration, a rectilinear beveled edge 8 or a rounded and beveled edge 9, or also a single point 10, as shown in FIGS. 3, 4, and 5, respectively.

The obtuse angle between the first section 2 and the second section 4 of the metal plate enables the third section 5 to be driven into an object 3 by means of the device which will be described hereinafter. The obtuse angle also allows sufficient detachment of the second section from the object in order to enable the clip to be fastened by means of a hook.

As mentioned earlier, the invention also relates to a device for fitting clips such as the one described above. As can be seen in FIGS. 6–10, the device has a base 11 which is flat. The base 11 has a graduated beam 12 against which will be placed an object 31, into which a clip is to be driven.

A bracket 13 consists of two side bars 13*a* and 13*b*, which are parallel to each other. The two side bars rest on the base 11.

The device also has a rocking assembly 14, which is formed by two rectangular components 14*a* and 14*b*. The two components 14*a* and 14*b* are hinged at first ends to the bracket 13 around an axis 15. Therefore, rocking assembly 14 can rotate about the axis 15 between a high position, called the position of rest, and a low position, called the contact position. Head 17 of an operating means 18 is located at the second end of the components 14*a* and 14*b* of the rocking assembly 14. Thus, the head 17 can assume a rearward position, called the loading position, and a forward position, called the drive-in position. The operating mechanism 18 also has a lever 19 which is integral with head 17. The lever 19 is substantially perpendicular to rocking assembly 14 and extends above the bracket 13 when the rocking assembly 14 is in the rest position and the head is in the loading position.

The upper face of head 17 is the face seen by the user when the rocking assembly 14 is in the position of rest and the head is in the loading position. The upper face of head 17 has located thereon a pressure stud 20 and a magnet 21.

The rotation of the rocking assembly 14 about the axis 15 is limited by two stops and formed by parallel points located between the two side bars 13*a* and 13*b* of bracket 13. First stop 22 determines the position of rest in which the rocking assembly 14 is substantially vertical. The second stop 23 determines the contact position and is situated such that the rocking assembly 14 is in a substantially vertical position, but the end of the rocking assembly 14 which carries head 17 is near base 11.

The rotation of head 17 about the axis 16 is limited on one side by a stop 24 formed by an end of a screw 24*a*. The stop 24 traverses a stay rod 24*b* positioned between the two elements 14*a* and 14*b*. The stop 24 comes into contact with the lower face of head 17 when the head 17 is in the rearward position, called the loading position. The rotation of head 17 about axis 16 is limited on the other side, by a pin 26 located between the two elements 14*a* and 14*b*. The pin 26 cooperates with an adjustable stud 25 located on head 17 in order to determine the forward position, called the drive-in position, of the head 17. The length of the adjustable stud 25 is fixed in accordance with the length of the third section 5 of the clip.

After rotating about the axis 15, the rocking assembly 14 returns to the position of rest by the action of a first helical spring 27. One end of the helical spring 27 is fixed on a first bar 28. The first bar 28 is disposed between the two side bars 13*a* and 13*b* of bracket 13 in back of first stop 22. The other end of the helical spring 27 is extended by a wire 27*a* made of the same material as the spring. The other end of the helical spring 27 is attached to a second bar 29 which is placed between the two elements 14*a* and 14*b* of the rocking assembly 14. The second bar 29 is placed such that wire 27*a* passes above pin 15.

A second helical spring 30 allows head 17 to rotate from the drive-in position to the loading position. One end of the helical spring 30 is fixed on the second bar 29. The other end of spring 30 is fixed on the lower face of head 17 near the connection of the head with lever 19.

The rigidity of the second helical spring 30 is greater than that of the combination of the first helical spring 27 and the wire 27*a*.

Figure 6:
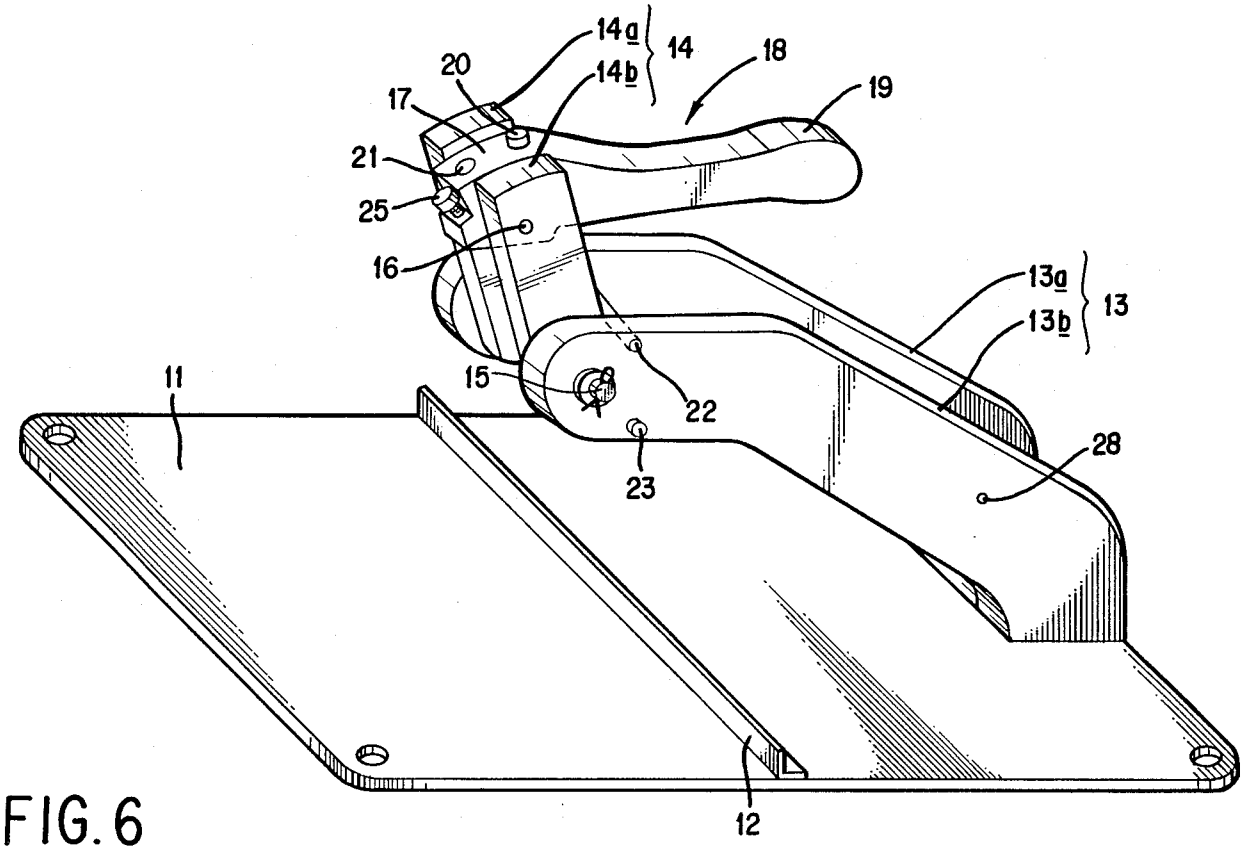
FIG. 6 is a perspective view of a device for fastening the clip shown in FIGS. 1 and 2.
Figure 7:
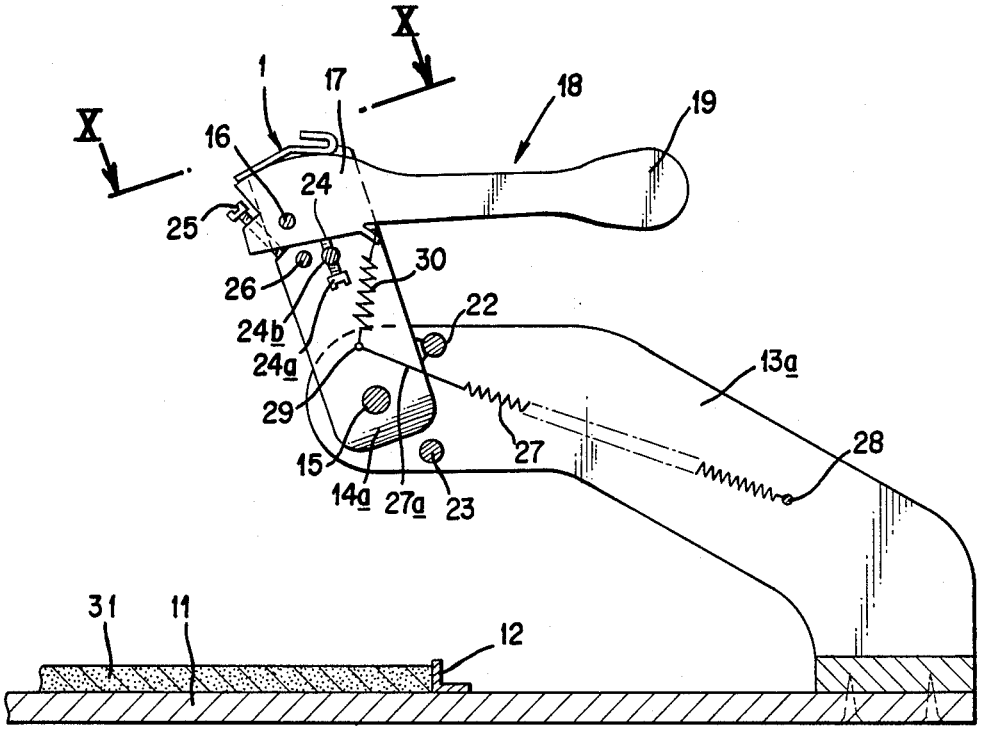
FIG. 7 is a broken-away view of the device in FIG. 6.
Figure 10:
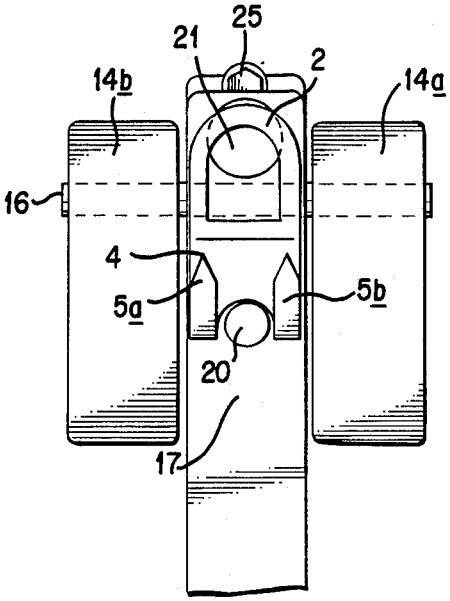
FIG. 10 is a top plan view of the head taken along the line X—X of FIG. 7.

When the clip-fitting device is in the position of rest, as shown in FIG. 6, the rocking assembly 14 is in a substantially vertical position and bearing against upper stop 22 so that head 17 is above pin 15. In this position, head 17 is in the loading position. The end of screw 24*a* bears against the lower side of the head. Thus, a clip can be placed on the head. The first section 2 of the clip is in contact with magnet 21. The central cutout 6 presses firmly against pressure stud 20. Points 5*a* and 5*b* point in a direction that is opposite that of lever 19 (FIG. 10).

Figure 8:
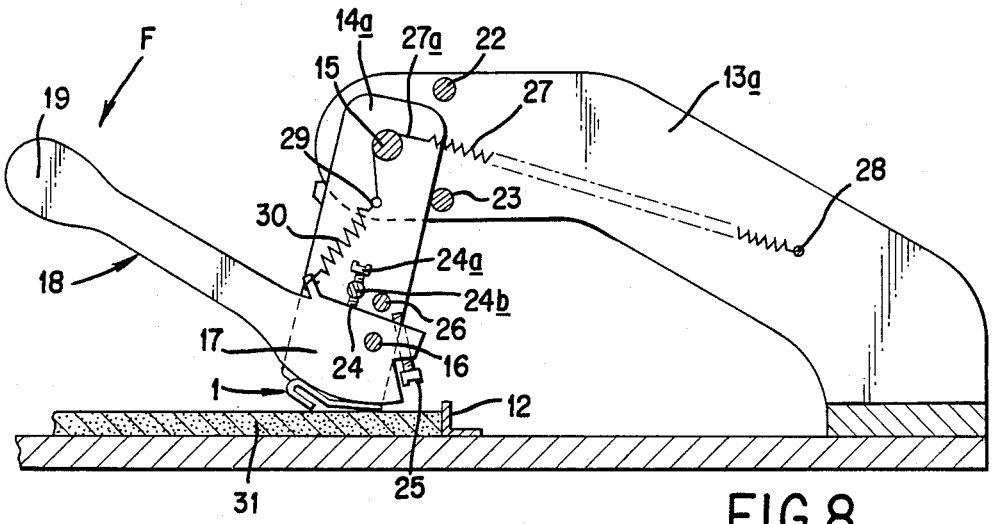
FIG. 8 is a view of the device shown in FIG. 7, with the clip in contact with an object.

When lever 19 is lowered, as shown by arrow F in FIG. 8, the rocking assembly 14 is pivoted about the axis 15 in order to bring the rocking assembly 14 to a substantially vertical position. The head 17 is now located below pin 15 and the operating mechanism pivots about axis 16, since second spring 30 is more rigid than first spring 27. The rocking motion comes to an end when rocking assembly 14 comes into contact with the lower stop 23 and at the same time the pivoting of the rocking assembly 14 causes the first return spring 27 to be stretched.

In the lower position, or in the contact position, shown in FIG. 8, the head 17 is very close to the object 31. The points 5*a* and 5*b* of the clip are, in a manner of speaking, touching the object.

Figure 9:
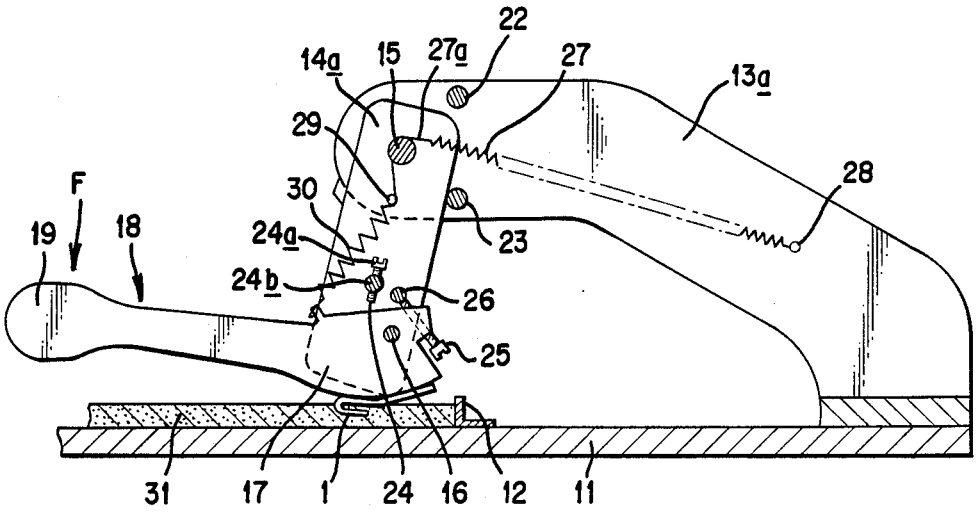
FIG. 9 is a view of the device shown in FIGS. 7 and 8, with the clip driven into the object.

While continuing to apply a force F on lever 19, the head 17 is caused to rotate about the axis 16 so that the head 17 rotates from the loading position to the drive-in position. During this movement, pressure stud 20 exerts a thrust against the edge of central cutout 6, causing the points 5*a* and 5*b* to be driven into object 31 (FIG. 9). In addition, since this thrust occurs at a fold relatively close to the point 7, where the clip is folded back, and relatively close to points 5*a* and 5*b*, only a small distance will arise between the second section 4 and the third section 5 of the clip when the third section 5 is being driven into object 31.

Once the head 17 arrives at the drive-in position, the force on lever 19 is neutralized, causing head 17 first to return to the loading position due to the effect of the second helical spring 30. Then, in the next phase, the rocking assembly 14 is restored to its position of rest by the thrust of the first helical spring 27. Another clip can then be fixed on head 17 in order to drive it into the same object 31 or into another object.

Figure 11:
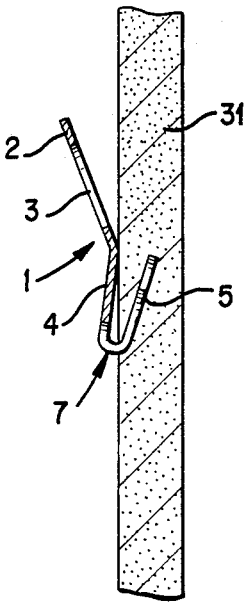
FIG. 11 is a cross-sectional view showing the position of a clip after it has been driven into an object.

As shown in FIG. 11, the third section 5 of the clip is driven at an angle into object 31 and the fold 7 is only slightly opened. Only the junction zone between the first section 2 and the second section 4 is firmly pressed against object 31. The first section 2 is sufficiently detached from the object 31, so that it can readily be fastened to a support by means of a hook.

Since the clip has an obtuse angle between the first section 2 and the second section 4, not only can object 31 be fastened to a support by means of a hook, but the clip can also be driven in by means of a device that has a curved head and is activated by a circular motion.

According to another embodiment, the head of the clip-fitting device can be provided with a second stud, called a traction stud, which can be placed in the hole of the clip. Thereby, the magnet, which is located on the head 17 to hold the clip during rotation, is placed between the two studs and cooperates with the second section of the clip.

Because of the different possible thicknesses of the objects into which the clips may be driven, as taught by the invention, the clip-fitting device may have a means of adjusting the height of the rocking assembly 14 in relation to the base 11.

Also, if the object 31 is made of a hard material such as wood, it may be necessary to provide guide holes in the object to facilitate the penetration of the clip. This particularly applies to wood frames.

It is apparent that, in this invention, working modes different in a wide range can be formed on the basis of the invention without deviating from the spirit and scope of the invention This invention is not restricted by its specific working mode except being limited by the appended claims.

What is claimed is:

1. A clip for hooking an object to a support comprising:

a metal plate, said plate including a first section having first and second sides and having a hanging means for hanging the object, a second section having first and second sides, said first side forming an obtuse angle with said first side of said first section, and a third section which is folded back along the second side of the second section so that said third section does not lie inside said obtuse angle formed between said first sides of said first and second sections, said third section includes a penetrating means for penetrating the object which is to be hung.

2. The clip as set forth in claim 1, wherein the second section comprises a central cutout that enables said clip to be placed on a clip-fitting device which drives the clip into the object to be hung.

3. The clip as set forth in claim 1 or 2, wherein the hanging means is a hole made in the first section.

4. The clip as set forth in claims 1 or 2 wherein the penetrating means includes of at least a rectilinear and a rounded beveled edge which determines a free end of the third section.

5. The clip as set forth in claims 1 or 2 wherein the penetrating means includes a point having a tip which is located in a plane of symmetry of said clip, said point constituting the third section.

6. The clip as set forth in claim 2 wherein the penetrating means includes two points which extend the second section on both sides of the central cutout, said two points forming the third section.

7. The clip as set forth in claim 1 or 2 wherein the obtuse angle formed by the first and second sections is between 145 and 165 degrees.

* * * * *